United States Patent [19]

Matidori et al.

[11] Patent Number: 4,755,235

[45] Date of Patent: Jul. 5, 1988

[54] ELECTRICALLY CONDUCTIVE PRECIPITATION HARDENED COPPER ALLOY AND A METHOD FOR MANUFACTURING THE SAME

[75] Inventors: Seika Matidori, Tokyo; Masato Sakai, Yokohama, both of Japan

[73] Assignee: Tokyo Shibaura Denki Kabushiki Kaisha, Kawasaki, Japan

[21] Appl. No.: 840,994

[22] Filed: Mar. 17, 1986

Related U.S. Application Data

[63] Continuation of Ser. No. 537,162, Sep. 30, 1983, abandoned, which is a continuation of Ser. No. 169,746, Jul. 17, 1970, abandoned.

[30] Foreign Application Priority Data

Jul. 30, 1979 [JP] Japan ..... 54-96067

[51] Int. Cl.[4] ..... C22C 9/00; C22F 1/08

[52] U.S. Cl. ..... 148/12.7 C; 148/411; 29/527.7

[58] Field of Search ..... 420/492, 494, 490; 148/411, 432, 2, 11.5 C, 12.7 C; 29/527.7; 72/700

[56] References Cited

U.S. PATENT DOCUMENTS

| | | | |
|---|---|---|---|
| 2,281,691 | 5/1942 | Hensel et al. | 148/160 |
| 3,107,998 | 10/1963 | Saarivirta | 75/153 |
| 3,143,442 | 8/1964 | Watts | 75/153 |
| 3,357,824 | 12/1967 | Saarivirta | 148/32.5 |
| 3,392,016 | 7/1968 | Opie et al. | 75/153 |
| 3,574,001 | 4/1971 | Ence | 148/32.5 |
| 3,717,511 | 2/1973 | Wallbaum | 148/11.5 C |
| 3,778,318 | 12/1973 | Finlay et al. | 148/32.5 |
| 4,047,980 | 9/1977 | Watson et al. | 148/12.7 C |
| 4,049,426 | 9/1977 | Watson et al. | 148/32.5 |
| 4,067,750 | 1/1978 | Mravic et al. | 148/411 |
| 4,198,248 | 4/1980 | Mandigo et al. | 75/153 |
| 4,224,066 | 9/1980 | Watson et al. | 148/11.5 C |

FOREIGN PATENT DOCUMENTS

| | | | |
|---|---|---|---|
| 2243731 | 3/1974 | Fed. Rep. of Germany | 75/153 |
| 50-122418 | 9/1975 | Japan | 75/153 |
| 50-122417 | 9/1975 | Japan | 75/153 |
| 121121 | 9/1975 | Japan | 420/494 |
| 51-154159 | 12/1976 | Japan . | |
| 52-3523 | 1/1977 | Japan | 75/153 |
| 53-78921 | 7/1978 | Japan | 420/492 |
| 578412 | 6/1980 | Japan | 148/11.5 C |

OTHER PUBLICATIONS

Taubenblat et al., "A New Copper Alloy with High Strength and Conductivity", Metals Engineering Quarterly, Nov. 1972, pp. 41–44.

Opie et al., "Properties of W-Mg-Zr and Cu-Cr-Zr-Mg Alloys with Improved Conductivity/Strength Characteristics", Journal of the Institute of Metals, 1970, vol. 98, pp. 204, 205 & 207.

*Primary Examiner*—Deborah Yee

*Attorney, Agent, or Firm*—Cushman, Darby & Cushman

[57] ABSTRACT

An electrically conductive copper alloy material for such as electric wires is disclosed whose grain size number is adjusted to be not less than 7 (JIS G 0551) which corresponds substantially to ASTM E112 by making an ingot of a copper alloy containing Cr and/or Zr, hot-working it to a wire of suitable diameter, and repeatedly annealing and cold-working it. A method for manufacturing such material is also disclosed.

16 Claims, No Drawings

ELECTRICALLY CONDUCTIVE PRECIPITATION HARDENED COPPER ALLOY AND A METHOD FOR MANUFACTURING THE SAME

This is a continuation of application Ser. No. 537,162, filed Sept. 30, 1983, which is a continuation of application Ser. No. 169,746, filed July 17, 1970, both of which are abandoned.

The present invention relates to an electrically conductive copper alloy material having both electrical conductivity and mechanical strength, and a method for manufacturing the same.

Although copper is excellent in electrical conductivity, the electrical conductivity of a copper alloy is necessarily less than that of pure copper. Therefore, it is general practice to use pure copper in electric wires, cables and the like where the electrical conductivity is very important. However, when a twisted wire is manufactured from pure copper, it is defective in that it tends to overstretch or it is often accidentally broken during the twisting process when the wire diameter is small. Thus, it is proposed to use a copper alloy member with an additive for improving the mechanical strength. However, this is not suitable for electric wires or the like where the electrical conductivity is of prime importance. For example, it is possible to improve the mechanical strength of chromium-copper, zirconium-copper and so on by the precipitation hardening treatment. However, this results in a lower electrical conductivity, and this method is not suitable for mass production of, for example, electric wires since the solution treatment and the precipitation hardening treatment must then be performed.

The primary object of the present invention is therefore to provide a copper alloy material which eliminates the problems of the conventional copper alloy member and which has an electrical conductivity, mechanical strength and suitability for mass production compatible with use an electric wires.

To the above and other objects, the present invention provides an electrically conductive copper alloy material whose grain size number is not less than 7 as defined by JIS G 0551.

The present invention further provides a method for manufacturing an electrically conductive copper alloy material which is characterized by making an ingot, hot-working it to a wire of suitable diameter, and, without subjecting it to the solution treatment, cold-working it so as to provide a grain size number of not less than 7 as defined by JIS G 0551.

The most important point of the present invention is the finding of a copper alloy material having a suitable electrical conductivity and mechanical strength by obtaining a grain size number of not less than 7, preferably 8–9 as defined by JIS G 0551 by preferably repeatedly annealing and working the copper alloy material without the solution treatment which has heretofore required a precipitation hardening treatment. The suitability for mass production obtained by eliminating the step of the solution treatment is also industrially advantageous.

The crystal grain size as defined by JIS G 0551 is calculated as follows.

$$n = 500\left(\frac{M}{100}\right)^2\left(\frac{I_1 \times I_2}{L_1 \times L_2}\right)$$

$$N = \frac{\log n}{0.301} + 1$$

Herein,

N: grain size number;

n: the number of grains counted within 25 mm square as magnified 100 times;

M: magnification of a microscope;

$L_1$ (or $L_2$): the total length of the whole segments in the direction of one of the lines crossing at right angles;

$I_1$ (or $I_2$): the total of the number of grains crossed by line $L_1$ (or $L_2$).

Relationships of grain size number with the number of grain per unit, the size of grain and the average number of grain per unit are exemplified in the Table I below. The definition of JIS G-0551 corresponds substantially to ASTM E112.

TABLE I

| Grain size number | The number of grains per 1 mm$^2$ | Average cross-sectional area of grain | Average number of grains within 25 mm at 100 times magnification |
|---|---|---|---|
| 5 | 256 | 0.00390 | 16 |
| 6 | 512 | 0.00195 | 32 |
| 7 | 1,024 | 0.00098 | 64 |
| 8 | 2,048 | 0.00049 | 128 |
| 9 | 4,096 | 0.000244 | 256 |
| 10 | 8,192 | 0.000122 | 512 |

A method for making an ingot of a starting copper alloy material before adjusting its grain size number to not less than 7 as defined by JIS G 0551 will first be described.

Making an ingot can be performed by general vacuum melting or atmospheric melting using a carbon melting pot.

In the latter ingot making method, oxygen, for example, is degassed in the form of $CO_2$ with the use of a carbon melting pot. When the cooling time after the melting of the alloy is shortened, the control of components which are liable to be oxidized can be easily carried out. In the easiest and most efficient method, part of the desired copper base amounting about 10% in general of the total is thrown in after adding the additives for quenching the molten alloy. The base metal material preferably comprises a material containing little oxygen, such as a return material or oxygen free copper.

Quenching in this case means fast cooling from a temperature of 1,200°–1,250° C. at which the additives are added to a casting temperature of 1,100°–1,150° C. within a period of only 1–2 minutes. This method which adopts a carbon melting pot, is especially advantageous for a chromium-copper alloy, a zirconium-copper alloy, a chromium-zirconium-copper alloy and so on.

Chromium is preferably added in the form of a base alloy of chromium-copper alloy. This is because the addition of metallic chromium tends to cause segregation due to a difference in melting points and small solid solubility.

Zirconium may be added only for deoxidation or for inclusion in the alloy.

Zirconium to be included in the alloy is added separately from zirconium for deoxidation. That is, after sufficiently deoxidizing with zirconium, more zirconium to be included in the alloy may be added. The addition of Zr is in general preferably performed at a temperature higher than the melting point of the copper alloy. For adding both chromium and zirconium, after adding a chromium-copper base alloy, zirconium is added for deoxidation and more zirconium to be included in the alloy is added. This is because Zr is easily oxidized, and the addition of Zr is thus difficult before sufficiently deoxidizing the electrolytic copper. Special components such as silicon, germanium, magnesium, boron and so on are added after the deoxidation by zirconium as needed. This is because addition of these elements after sufficient deoxidation results in a better yield. Boron is added simultaneously with chromium as a base metal. The ingot making method of the Cr-Zr-Cu alloy may be summarized as follows:

(1) Placing the electrolytic copper in an amount which is about 10% (by weight) less than the required amount.
(2) Raising the temperature to 1,080°–1,150° C.
(3) Melting the copper.
(4) Adding the Cu-Cr base alloy, Cu-B base alloy and so on.
(5) Adding a flux and removing the slag (the flux is in general cryolite).
(6) Raising the temperature to 1,200°–1,250° C.
(7) Adding Zr for deoxidation.
(8) Adding a flux and removing the slag.
(9) Adding Si, Ge, Mg, and so on.
(10) Adding Zr.
(11) Adding Cu (the rest of the Cu in (1)) for quenching to a temperature of 1,100°–1,150° C. Then, adding a flux and removing the slag during this process.
(12) Casting.

The features of the copper alloy melted by this method are found to be the same as those of a copper alloy obtained by a conventional vacuum melting method, and have the following advantages.

(1) It is possible to obtain products without an addition of an additive.
(2) Inclusion of impurities will be effectively prevented.
(3) Additives will be effectively alloyed with copper.
(4) Segregation of additives will be effectively prevented.

The atmospheric melting method which uses a carbon melting pot is advantageous in that it does not require special equipment as in the vacuum melting method and the manufacturing cost may be made less.

This atmospheric melting method may be advantageously applicable particularly to alloys such as 0.05–1.5% Cr-Cu, preferably 0.3–1.5% Cr-Cu, more preferably 0.3–0.9% Cr-Cu; 0.05–0.5% Zr-Cu, preferably 0.1–0.5% Zr-Cu, more preferably 0.1–0.4% Zr-Cu; 0.3–1% Cr-Cu, 0.1–0.5% Zr-Cu; and Cu alloys containing further 0.005–0.1%, preferably 0.01–0.03% in total (all by weight) of silicon, germanium, boron or magnesium in addition to above ranges of Cr and Zr.

The present invention will now be described in more detail taking as an example a copper alloy consisting of 0.81% by weight of chromium, 0.30% by weight of zirconium, and the rest, copper.

In this example, the copper alloy material is repeatedly annealed and cold-worked after hot-working in order to obtain optimum results.

The alloy of the above composition was hot-worked at a temperature of 700°–850° C. by the atmospheric melting method using a carbon melting pot so as to obtain a wire of 7–10 mm in diameter. Then thus obtained wire was cold-worked after acid cleaning into a wire of 2 mm in diameter. After annealing it at a temperature of 500°–650° C., it was further cold-worked into a wire of 0.26 mm in diameter. The characteristics of a copper alloy of cold working finish, a copper alloy of annealing finish at a temperature of 550° C., a copper alloy obtained by a conventional precipitation hardening treatment and pure copper are shown in Table II.

TABLE II

| Characteristics | Alloy of present invention (annealing finish) | Alloy of present invention (cold working finish) | Pure copper | Alloy obtained by precipitation hardening treatment |
|---|---|---|---|---|
| Electrical conductivity (IACS %) | 92 | 88 | 100 | 80 |
| Thermal conductivity (cal/cm · deg) | 0.90 | 0.86 | 0.95 | 0.78 |
| Resistance to acid ($mg/cm^2$) | 10 | 10 | 75 | 10 |
| Tensile strength ($kg/mm^2$) | 45 | 50 | 20 | 60 |
| Offset yield stress ($kg/mm^2$) | 30 | 40 | 6 | 57 |
| Repeated bending (number of times) | 9 | 6 | 2 | 4 |
| Pliability | Good | Good | Good | Bad |
| Plating readiness | Good | Good | Good | Good |
| Formability into wire | Good | Good | Bad | Good |
| Grain size number | 10 | 9 | 8 | 5–6 |

The evaluation method was as follows:

Electrical conductivity (IACS: International Annealed Copper Standard %):

The specific resistance was measured at room temperature and was converted, taking 0.7241 (International Standard copper specific resistance) as 100.

Thermal conductivity (cal/cm·deg):

The substance constant defining the energy which passes through a unit area during a certain period of time.

Resistance to acid (mg/cm$^2$):

The increase in oxidation when heated at 400° C. for 30 Hrs.

Tensile strength:

A tensile force required to break (kg/mm$^2$).

Offset yield stress (kg/mm$^2$):

Stress when distorted 0.2%.

Repeated bending:

The number of bends until the substance is broken, when bends are repeated with a load of 250 gr, at 0.3 R through 90 degrees.

Pliability:

Presence or absence of flexibility when twisted in wire form.

Plating readiness:

Suitability for plating of Ag, Au, Ni, solder and so on.

Formability into wire:

Ease of forming into wire form (resistance to breakage: compared with pure Cu).

Grain size number:

According to JIS G 0551.

manufacturing procedure. In contrast to this, these defects are not noted with the alloy of the present invention. Therefore, this is especially preferable for use in a twisted form. Breakage and overstretching are related to the offset yield stress and formability into wire according to the present inventors. Thus, the alloy of the present invention is excellent in offset yield stress and formability into wire and is therefore especially suitable for use in electric wires and cables.

When twisted wires are manufactured from this wire material, no noticeable breakage or stretching are observed and the grain forms are equivalent as those before twisting process.

The characteristics of alloys with a grain size number of not less than 7 manufactured by repeated annealings and cold workings without requiring the solution treatment in accordance with the method of the present invention are shown in Table III. These alloys are an alloy (A) of 1% by weight of chromium and copper; an alloy (B) of 0.15% by weight of zirconium and copper; an alloy (C) of 0.7% by weight of chromium, 0.3% by weight of zirconium and copper; an alloy (D) of 1% by weight of chromium, 0.03% by weight of silicon and copper; an alloy (E) of 0.15% by weight of zirconium, 0.03% by weight of silicon and copper; and an alloy (F) of 0.7% by weight of chromium, 0.15% by weight of zirconium, 0.03% by weight of silicon and copper.

When germanium, boron and magnesium were used in place of silicon in each alloy (D), (E) or (F), almost the same results were obtained.

Silicon, germanium, boron, magnesium and so on are effective for improving the mechanical strength and for suppressing the generation of coarse grains.

TABLE III

| Characteristics | Cu—1% Cr (A) | Cu—0.15% Zr (B) | Cu—0.7% Cr—0.3% Zr (C) | Cu—1% Cr—0.03% Si (D) | Cu—0.15% Zr—0.03% Si (E) | Cu—0.7% Cr—0.15% Zr—0.03% Si (F) |
|---|---|---|---|---|---|---|
| Grain size number | 8–9 | 8–9 | 9–10 | 9–10 | 9–10 | 10–11 |
| Electrical conductivity (IACS %) | 88–95 | 90–97 | 88–95 | 88–95 | 90–97 | 88–95 |
| Thermal conductivity (cal/cm · deg) | about 0.90 | 0.92 | 0.90 | 0.92 | 0.94 | 0.92 |
| Resistance to acid (mg/cm$^2$) | 18 | 18 | 15 | 12 | 12 | 10 |
| Offset yield stress (kg/mm$^2$) | 23–40 | 22–35 | 28–45 | 25–40 | 23–35 | 30–48 |
| Repeated bending (number of times) | 3–6 | 4–7 | 4–9 | 3–7 | 4–8 | 4–10 |
| Pliability | Good | Good | Good | Good | Good | Good |
| Plating readiness | Good | Good | Good | Good | Good | Good |
| Formability into wire | Good | Good | Good | Good | Good | Good |

Thus, since the electrical conductivity changes depending on whether the alloy is of working or annealing finish, desired characteristics may be easily obtained. The grain forms are, in an alloy of rolling finish, relatively elongated and, in an alloy of annealing finish, relatively circular.

The procedure for using the alloy of the present invention for electric wires and cables will now be described.

As was described earlier, pure copper is defective in that it tends to break or stretch too much during the In accordance with the present invention, improvements are realized in electrical conductivity, thermal conductivity, resistance to acid, offset yield stress, flex, resistance to fatigue and creep rupture, pliability, plating readiness and formability into wire. Thus, the present invention results in improvements in fields where pure copper has been conventionally used.

The electrically conductive copper alloy of the present invention may be applied in wide range including cables for welders, elevator cables, jumpers for vehicles, crane cables, trolly hard copper twisted wires of cable rack wires for power stations and substations, lead wires and so on.

Although the above description has been made with reference to a chromium-zirconium-copper alloy, it is to be clearly understood that the above technique is applicable to other copper alloys which are conventionally known as materials for precipitation hardening materials.

What we claim is:

1. An electrically conductive precipitation hardened copper alloy material consisting of 0.05–1.5% by weight of chromium and optionally 0.05–0.5% by weight of zirconium, the balance copper, said copper alloy having a grain size number not less than 8 as defined by ASTM E112, having a minimum electrical conductivity of about 88 (IACS%), and a minimum offset yield stress of about 22 kg/mm$^2$.

2. A copper alloy material as recited in claim 1 wherein the grain is of the shape obtained by rolling finish or annealing finish.

3. A copper alloy material as recited in claim 1 wherein the composition of the copper alloy is 0.05–1.5% by weight of chromium and the balance of copper.

4. A copper alloy material as recited in claim 1 wherein the composition of the copper alloy is 0.3–1.5% by weight of chromium and the balance of copper.

5. A copper alloy material as recited in claim 1 wherein the composition of the copper alloy contains 0.05–0.5% by weight of zirconium.

6. A copper alloy material as recited in claim 1 wherein the composition of the copper alloy contains 0.1–0.5% by weight of zirconium.

7. A copper alloy material as recited in claim 1 wherein the composition of the copper alloy is 0.05–1% by weight of chromium, 0.05–0.5% by weight of zirconium, and the balance of copper.

8. A copper alloy material as recited in claim 1 wherein the composition of the copper alloy is 0.3–1% by weight of chromium, 0.1–0.5% by weight of zirconium, and the balance of copper.

9. A method for manufacturing an electrically conductive copper alloy material wire consisting essentially of the steps:

(1) making a copper alloy ingot having a composition consisting of 0.05–1.5% by weight of chromium, 0.05–0.5% by weight of zirconium, and the balance of copper, (2) hot-working the ingot at a temperature in the range of about 700° C. to about 850° C., thereby forming the material into a wire of a predetermined diameter, and thereafter (3) cold-working without subjecting the wire to solution treatment, thereby producing a precipitation hardened copper alloy material having a grain size number of not less than 8 as defined by ASTM E112, a minimum electrical conductivity of about 88 (IACS %), and a minimum offset yield stress of about 22 kg/mm$^2$.

10. The electrically conductive copper alloy according to claim 1, wherein the grain size number is in the range of 9 to 11.

11. The electrically conductive copper alloy of claim 10 wherein the grain size number is in the range of about 9 to about 10.

12. An electrically conductive precipitation hardened copper alloy material consisting of 0.05–1.5% by weight of chromium and optionally 0.05–0.5% by weight of zirconium; at least one of silicon, germanium, boron or magnesium in a total amount of 0.005 to 0.1% by weight and the balance copper, said copper alloy having a grain size number of not less than 8 as defined by ASTM E112, having a minimum electrical conductivity of about 88 (IACS%), and a minimum offset yield stress of about 22 kg/mm$^2$.

13. The electrically conductive precipitation hardened copper alloy material according to claim 1, wherein the grain size number is in the range of from 8 to 11.

14. A wire made of the electrically conductive precipitation hardened copper alloy material of claim 1.

15. A twisted wire made of the electrically conductive precipitation hardened copper alloy material of claim 1.

16. A shaped article made of the electrically conductive precipitation hardened copper alloy material of claim 1.

* * * * *